US009713363B2

(12) United States Patent
Dojan

(10) Patent No.: US 9,713,363 B2
(45) **Date of Patent: *Jul. 25, 2017**

(54) FOOTWEAR HAVING AN UPPER WITH FOREFOOT TENSILE STRAND ELEMENTS

(71) Applicant: NIKE, Inc., Beaverton, OR (US)

(72) Inventor: Frederick J. Dojan, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/799,708

(22) Filed: Jul. 15, 2015

(65) Prior Publication Data

US 2016/0007686 A1 Jan. 14, 2016

Related U.S. Application Data

(62) Division of application No. 13/327,229, filed on Dec. 15, 2011, now Pat. No. 9,113,674.

(51) Int. Cl.

| | |
|---|---|
| ***A43B 23/02*** | (2006.01) |
| ***A43C 1/04*** | (2006.01) |
| ***A43C 5/00*** | (2006.01) |

(52) U.S. Cl.

CPC ..... *A43B 23/0245* (2013.01); *A43B 23/0225* (2013.01); *A43B 23/0235* (2013.01); *A43B 23/0265* (2013.01); *A43B 23/0275* (2013.01); *A43C 1/04* (2013.01); *A43C 5/00* (2013.01)

(58) Field of Classification Search

CPC ..... A43B 23/0225; A43B 23/0235; A43B 23/0245; A43B 23/0265; A43B 23/0275; A43C 1/04; A43C 5/00

USPC ..... 36/45, 47, 50.1, 51, 57, 58

See application file for complete search history.

(56) References Cited

U.S. PATENT DOCUMENTS

| | | | |
|---|---|---|---|
| 2,034,091 | A | 3/1936 | Dunbar |
| 2,048,294 | A | 7/1936 | Roberts |
| 2,205,356 | A | 6/1940 | Gruensfelder et al. |
| 2,311,996 | A | 2/1943 | Parker |
| 3,439,434 | A | 4/1969 | Tangorra |
| 3,672,078 | A | 6/1972 | Fukuoka |
| 3,823,493 | A | 7/1974 | Brehm et al. |
| 4,627,369 | A | 12/1986 | Conrad et al. |
| 4,634,616 | A | 1/1987 | Musante et al. |
| 4,642,819 | A | 2/1987 | Ales et al. |

(Continued)

FOREIGN PATENT DOCUMENTS

| | | | |
|---|---|---|---|
| CN | 101125044 | A | 2/2008 |
| CN | 104661548 | A | 5/2015 |

(Continued)

OTHER PUBLICATIONS

Notice of Allowance for Chinese Application No. 2012800618605, mailed on May 6, 2016.

(Continued)

*Primary Examiner* — Sharon M Prange

(74) *Attorney, Agent, or Firm* — Klarquist Sparkman, LLP

(57) ABSTRACT

Articles of footwear may include an upper with a forward lace-receiving element and a plurality of strands that extend forward from the lace-receiving element. In some configurations, the strands are located between a pair of material layers and lay substantially parallel to the material layers. In other configurations, the material layers form a loop structure, and the strands may extend at least partially around the loop structure.

15 Claims, 20 Drawing Sheets

(56) References Cited

U.S. PATENT DOCUMENTS

| | | | |
|---|---|---|---|
| 4,756,098 | A | 7/1988 | Boggia |
| 4,858,339 | A | 8/1989 | Hayafuchi et al. |
| 4,873,725 | A | 10/1989 | Mitchell |
| 5,149,388 | A | 9/1992 | Stahl |
| 5,156,022 | A | 10/1992 | Altman et al. |
| 5,271,130 | A | 12/1993 | Batra |
| 5,285,658 | A | 2/1994 | Altman et al. |
| 5,345,638 | A | 9/1994 | Nishida |
| 5,359,790 | A | 11/1994 | Iverson et al. |
| 5,367,795 | A | 11/1994 | Iverson et al. |
| 5,371,957 | A | 12/1994 | Gaudio |
| 5,380,480 | A | 1/1995 | Okine et al. |
| 5,399,410 | A | 3/1995 | Urase et al. |
| 5,564,203 | A | 10/1996 | Morris |
| 5,645,935 | A | 7/1997 | Kemper et al. |
| 5,832,540 | A | 11/1998 | Knight |
| D405,587 | S | 2/1999 | Merikoski |
| 5,930,918 | A | 8/1999 | Healy et al. |
| 5,990,378 | A | 11/1999 | Ellis |
| 6,003,247 | A | 12/1999 | Steffe |
| 6,004,891 | A | 12/1999 | Tuppin et al. |
| 6,009,637 | A | 1/2000 | Pavone |
| 6,029,376 | A | 2/2000 | Cass |
| 6,038,702 | A | 3/2000 | Knerr |
| 6,128,835 | A | 10/2000 | Ritter et al. |
| 6,151,804 | A | 11/2000 | Hieblinger |
| 6,164,228 | A | 12/2000 | Lin et al. |
| 6,170,175 | B1 | 1/2001 | Funk |
| 6,213,634 | B1 | 4/2001 | Harrington et al. |
| 6,505,424 | B2 | 1/2003 | Oorei et al. |
| 6,615,427 | B1 | 9/2003 | Hailey |
| 6,665,958 | B2 | 12/2003 | Goodwin |
| 6,718,895 | B1 | 4/2004 | Fortuna |
| 6,860,214 | B1 | 3/2005 | Wang |
| 6,910,288 | B2 | 6/2005 | Dua |
| 7,086,179 | B2 | 8/2006 | Dojan et al. |
| 7,086,180 | B2 | 8/2006 | Dojan et al. |
| 7,100,310 | B2 | 9/2006 | Foxen et al. |
| 7,117,616 | B2 | 10/2006 | Hull et al. |
| 7,293,371 | B2 | 11/2007 | Aveni |
| 7,337,560 | B2 | 3/2008 | Marvin et al. |
| 7,546,698 | B2 | 6/2009 | Meschter |
| 7,574,818 | B2 | 8/2009 | Meschter |
| 7,665,230 | B2 | 2/2010 | Dojan et al. |
| 7,676,956 | B2 | 3/2010 | Dojan et al. |
| 7,849,518 | B2 | 12/2010 | Moore et al. |
| 7,870,681 | B2 | 1/2011 | Meschter |
| 7,870,682 | B2 | 1/2011 | Meschter et al. |
| 8,122,616 | B2 | 2/2012 | Meschter et al. |
| 8,388,791 | B2 | 3/2013 | Dojan et al. |
| 9,113,674 | B2 | 8/2015 | Dojan |
| 2001/0051484 | A1 | 12/2001 | Ishida et al. |
| 2003/0178738 | A1 | 9/2003 | Staub et al. |
| 2004/0074589 | A1 | 4/2004 | Gessler et al. |
| 2004/0118018 | A1 | 6/2004 | Dua |
| 2004/0142631 | A1 | 7/2004 | Luk |
| 2004/0181972 | A1 | 9/2004 | Csorba |
| 2004/0261295 | A1 | 12/2004 | Meschter |
| 2005/0028403 | A1 | 2/2005 | Swigart et al. |
| 2005/0115284 | A1 | 6/2005 | Dua |
| 2005/0132609 | A1 | 6/2005 | Dojan et al. |
| 2005/0268497 | A1 | 12/2005 | Alfaro et al. |
| 2006/0048413 | A1 | 3/2006 | Sokolowski et al. |
| 2006/0137221 | A1 | 6/2006 | Dojan et al. |
| 2007/0199210 | A1 | 8/2007 | Vattes et al. |
| 2007/0271821 | A1 | 11/2007 | Meschter |
| 2008/0110049 | A1 | 5/2008 | Sokolowski et al. |
| 2010/0018075 | A1 | 1/2010 | Meschter et al. |
| 2010/0037483 | A1 | 2/2010 | Meschter et al. |
| 2010/0043253 | A1 | 2/2010 | Dojan et al. |
| 2010/0154256 | A1 | 6/2010 | Dua et al. |
| 2010/0175276 | A1 | 7/2010 | Dojan et al. |
| 2010/0251491 | A1 | 10/2010 | Dojan et al. |
| 2010/0251564 | A1 | 10/2010 | Meschter |
| 2010/0269369 | A1 | 10/2010 | Nishiwaki et al. |
| 2011/0041359 | A1 | 2/2011 | Dojan et al. |

FOREIGN PATENT DOCUMENTS

| | | | |
|---|---|---|---|
| DE | 3629339 | A1 | 3/1988 |
| DE | 20215559 | U1 | 1/2003 |
| EP | 0082824 | A2 | 6/1983 |
| EP | 0818289 | A2 | 1/1998 |
| EP | 2078468 | A1 | 7/2009 |
| EP | 2790545 | A1 | 10/2014 |
| FR | 1462349 | A | 2/1967 |
| FR | 2046671 | A5 | 3/1971 |
| FR | 2457651 | A1 | 12/1980 |
| WO | 9843506 | A1 | 10/1998 |
| WO | 03013301 | A1 | 2/2003 |
| WO | 2004089609 | A1 | 10/2004 |
| WO | 2007139567 | A1 | 12/2007 |
| WO | 2007140055 | A2 | 12/2007 |

OTHER PUBLICATIONS

International Preliminary Report on Patentability and Written Opinion for Application No. PCT/US2012/065993, mailed on Jun. 17, 2014.

International Preliminary Report on Patentability (including Written Opinion of the ISA) mailed Jun. 26, 2014 in International Application No. PCT/US2012/067736.

International Search Report and Written Opinion for Application No. PCT/US2012/065993, mailed Feb. 26, 2013.

FOOTWEAR HAVING AN UPPER WITH FOREFOOT TENSILE STRAND ELEMENTS

CROSS-REFERENCE TO RELATED APPLICATION

This non-provisional patent application is a division of and claims priority to U.S. patent application Ser. No. 13/327,229, entitled "Footwear Having An Upper With Forefoot Tensile Strand Elements", which was filed on Dec. 15, 2011, the disclosure of which application is entirely incorporated herein by reference.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart different properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal a lower surface of the foot to enhance footwear comfort.

SUMMARY

An article of footwear is described below as having an upper and a sole structure secured to the upper. The upper includes a throat area with a plurality of lateral lace-receiving elements extending along a lateral side of the upper, a plurality of medial lace-receiving elements extending along a medial side of the upper, and a forward lace-receiving element located between the lateral side and the medial side. A lace extends through the lateral lace-receiving elements, the medial lace-receiving elements, and the forward lace-receiving element. The upper also includes a tensile strand element located within a forefoot region of the footwear. The tensile strand element includes a plurality of strands that extend forward from an area proximal to the forward lace-receiving element.

In another aspect, the upper includes a first layer and a second layer that lay adjacent to each other, with the first layer and the second layer defining a tab area where the first layer and the second layer overlap to define a loop structure. A plurality of strands are located between the first layer and the second layer and substantially parallel to surfaces of the first layer and the second layer for a distance of at least five centimeters, and portions of the strands extend around the loop structure. A lace may also extend through the loop structure.

In yet another aspect, the upper includes a throat area having a plurality of lace-receiving elements that include a forward lace-receiving element positioned closer to a forward edge of the upper than other lace-receiving elements. A lace extends through at least the forward lace-receiving element. The upper also includes a tensile strand element with a first layer, a second layer, and a plurality of strands located between the first layer and the second layer. The strands lay substantially parallel to surfaces of the first layer and the second layer for a distance of at least five centimeters, and the strands extend from an area proximal to the forward lace-receiving element towards the forward edge of the footwear.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

BRIEF DESCRIPTION OF THE DRAWINGS

The foregoing Summary and the following Detailed Description will be better understood when read in conjunction with the accompanying figures.

DETAILED DESCRIPTION

Figure 1:
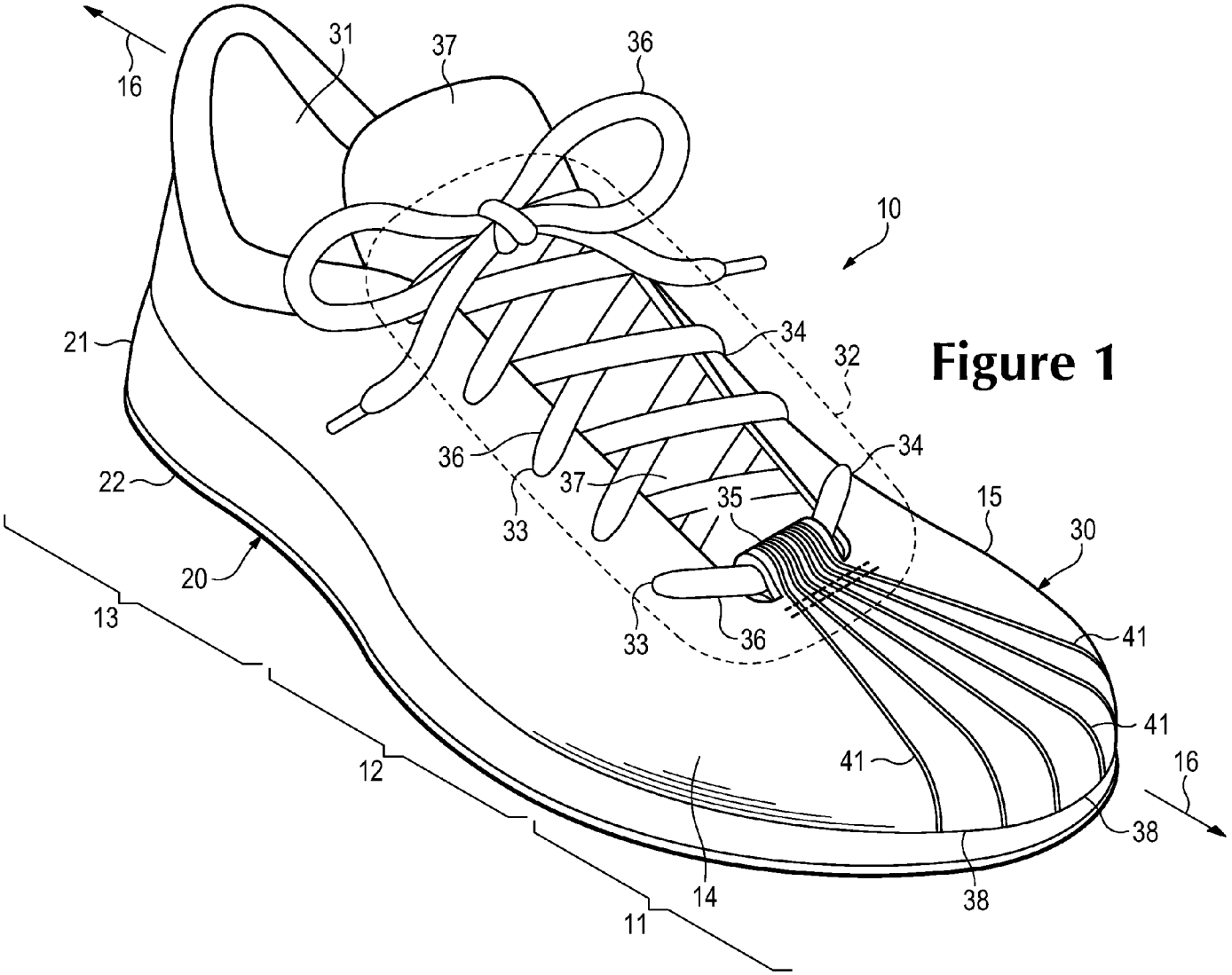
FIG. 1 is a perspective view of an article of footwear.

The following discussion and accompanying figures disclose an article of footwear having an upper that includes tensile strand elements. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

An article of footwear 10 is depicted in FIGS. 1-4 as including a sole structure 20 and an upper 30. For reference purposes, footwear 10 may be divided into three general regions: a forefoot region 11, a midfoot region 12, and a heel region 13. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Footwear 10 also includes a lateral side 14 and a medial side 15, which extend through each of regions 11-13 and correspond with opposite sides of footwear 10. More particularly, lateral side 14 corresponds with an outside area of the foot (i.e. the surface that faces away from the other foot), and medial side 15 corresponds with an inside area of the foot (i.e., the surface that faces toward the other foot). Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and an sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30 defines a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A throat area 32 extends forward (i.e., toward forefoot region 11) from ankle opening 31 and includes various lateral lace-receiving elements 33, medial lace-receiving elements 34, a forward lace-receiving element 35, a lace 36, and a tongue 37. Although throat area 32 is depicted as extending along and being centered on longitudinal axis 16, throat area 32 may be offset from longitudinal axis 16.

Lace-receiving elements 33-35 form structures that receive lace 36. Lateral lace-receiving elements 33 extend along throat area 32 and are located on lateral side 14. Similarly, medial lace-receiving elements 34 extend along throat area 32 and are located on medial side 15. In general, therefore, lace receiving elements 33 and 34 are located on opposite sides of longitudinal axis 16. Forward lace-receiving element 35 is located in a forward portion of throat area 32 and may be centrally-positioned so as to extend between sides 14 and 15. In some configurations, forward lace-receiving element 35 is the forward-most lace-receiving element in footwear 10 and is located closer to a forward edge 38 than other lace-receiving elements 33 and 34. Lace-receiving elements 33 and 34 are depicted as being apertures that extend through upper 30, and forward lace-receiving element 35 is depicted as having a tubular structure. In further configurations of footwear 10, each of lace-receiving elements 33-35 may be an aperture, tubular structure, D-ring, hook, or other structure that is suitable for receiving lace 36.

Lace 36 extends through the various lace-receiving elements 33-35. More particularly, lace 36 extends alternately and in a generally zigzagging (e.g., W-shaped) pattern through lateral lace-receiving elements 33 and medial lace-receiving apertures 34. Additionally, a portion of lace 36 located in the forward portion of throat area 32 extends through forward lace-receiving element 35. In general, lace 36 slides through the various lace-receiving elements 33-35 and permits a wearer of footwear 10 to modify the dimensions of upper 30, thereby accommodating the proportions of the foot. More particularly, lace 36 permits the wearer to tighten upper 30 around the foot, and lace 32 permits the wearer to loosen upper 30 to facilitate entry and removal of the foot from the void (i.e., through ankle opening 31).

Tongue 37 enhances the comfort of footwear 10 and assists with modifying the dimensions of upper 30. Within footwear 10, tongue 37 extends longitudinally through throat area 32 and is positioned below lace-receiving elements 33-35 and lace 36. As such, tongue 37 forms a portion of the void within upper 30 and contacts the foot. In some configurations, tongue 37 is secured to upper 30 in the forward portion of throat area 32. Although tongue 37 may have a variety of configurations, tongue 37 may be formed from a foam material that is surrounded by an exterior textile sheath. In some configurations tongue 37 may include a loop or other structure that receives lace 36 and assists with maintaining the position of tongue 37.

Figure 2:
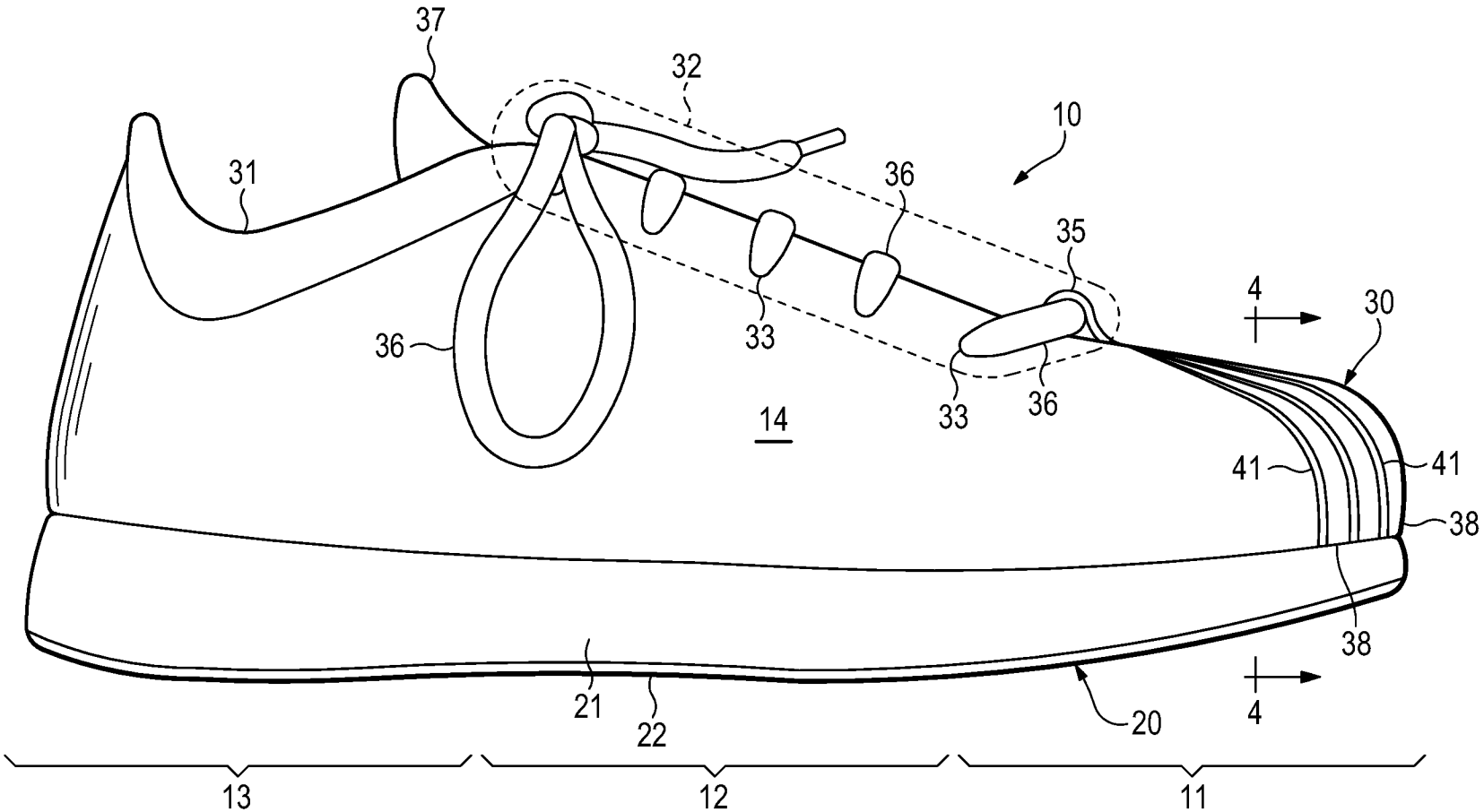
FIG. 2 is a lateral side elevational view of the article of footwear.
Figure 3:
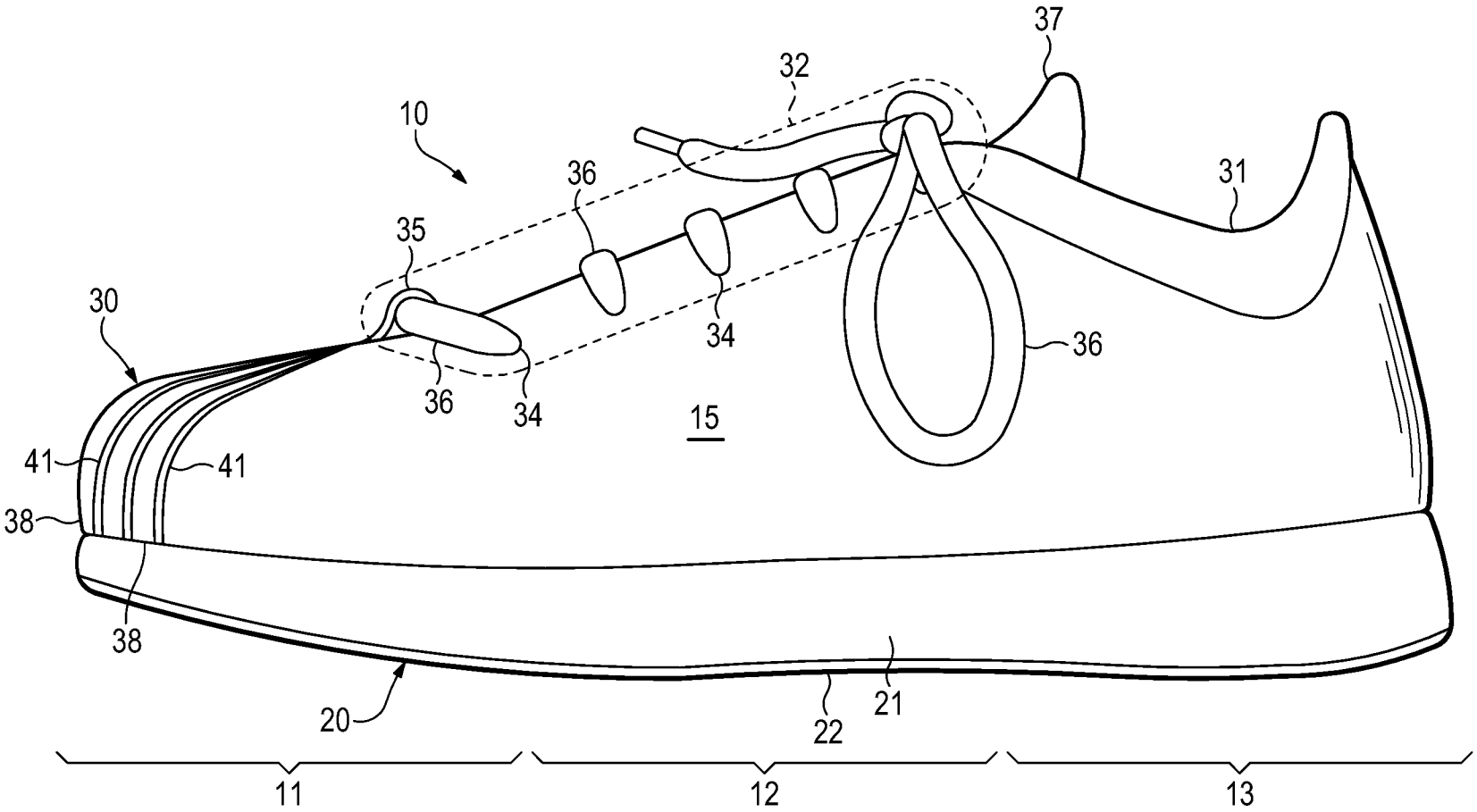
FIG. 3 is a medial side elevational view of the article of footwear.
Figure 4:
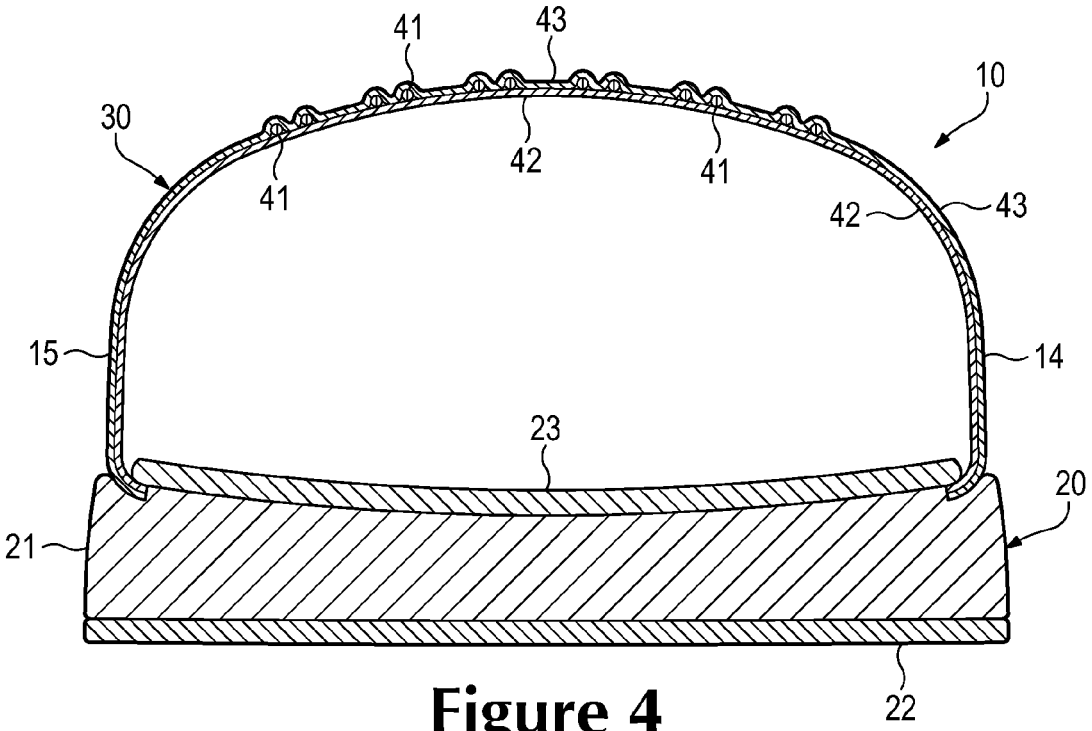
FIG. 4 is a cross-sectional view of the article of footwear, as defined by section line 4-4 in FIG. 2.

The various portions of upper 30 may be formed from one or more of a plurality of material elements (e.g., textiles, polymer sheets, foam layers, leather, synthetic leather) that are stitched or bonded together to form the void within footwear 10. Upper 30 may also incorporate a heel counter that limits heel movement in heel region 13 or a wear-resistant toe guard located in forefoot region 11. Indicia in the form of trademarks, for example, may also be secured or printed on upper 30. Although a variety of material elements or other elements may be incorporated into upper, forefoot region 11 includes a plurality of strands 41. Referring to FIGS. 1-3, strands 41 extend forward from forward lace-receiving element 35. More particularly, strands 41 extend from forward lace-receiving element 35 to forward edge 38, which is proximal to an area where sole structure 20 and upper 30 are secured to each other in forefoot region 11. Moreover, strands 41 extend onto and at least partially around the tubular structure forming forward lace-receiving element 35. Referring also to FIG. 4, the various strands 41 are located between a base layer 42 and a cover layer 43 (i.e., first and second material layers). Whereas base layer 42 forms a surface of the void within upper 30, cover layer 43 forms a portion of an exterior or exposed surface of upper 30. The combination of strands 41, base layer 42, and cover layer 43 may, therefore, form substantially all of the thickness of upper 30 in some areas. In further configurations, additional layers or material elements may be utilized in combination with layers 42 and 43.

During walking, running, or other ambulatory activities, a foot within the void in footwear 10 may tend to stretch upper 30. Additionally, utilizing lace 36 to modify the dimensions of upper 30 may tend to stretch upper 30. That is, many of the material elements forming upper 30 may stretch when placed in tension by movements of the foot or through lacing upper 30. Although strands 41 may also stretch, strands 41 generally stretch to a lesser degree than the other material elements forming upper 30 (e.g., base layer 42 and cover layer 43). Each of strands 41 may be located, therefore, to form structural components in upper 30 that resist stretching in specific directions or reinforce locations where forces are concentrated.

As structural components, strands 41 are generally located in forefoot region 11 to resist stretch in forefoot region 11 that may arise from walking, running, or other ambulatory activities. Strands 41 also extend around forward lace-receiving element 35 and forward from forward lace-receiving element 35 to resist stretch due to tension in lace 32. Given that strands 41 also radiate outward from forward lace-receiving element 35, forces from the tension in lace 32 or from movement of the foot may be distributed over a relatively large area of upper 30. In general, therefore, the locations and orientations of strands 41 form structural components in upper 30 that resist stretch, particularly in forefoot region 11 and the portion of upper 30 located forward of throat area 32.

Tensile Strand Element

Figure 5:
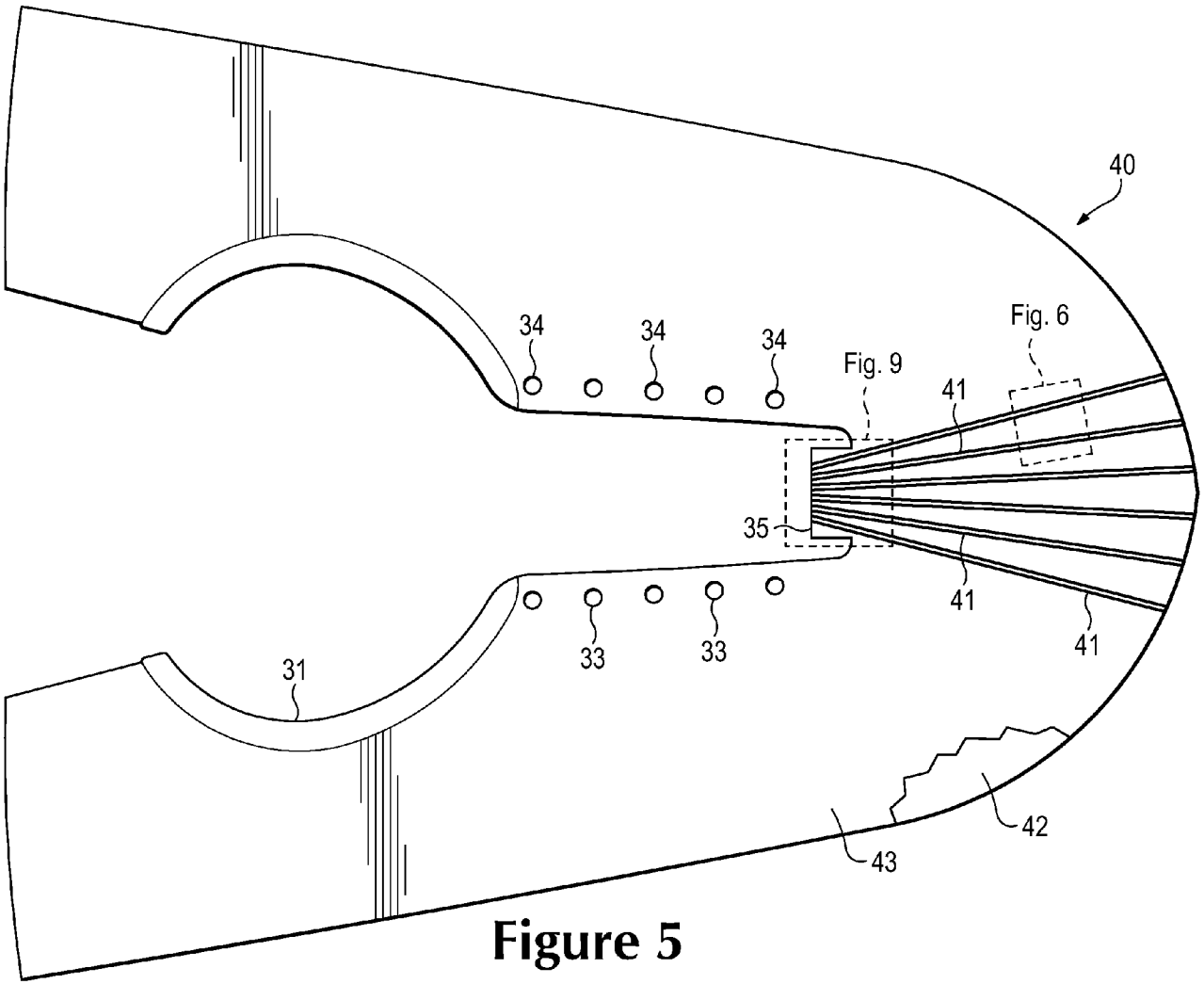
FIG. 5 is a plan view of a tensile strand element utilized in an upper of the article of footwear.
Figure 6:
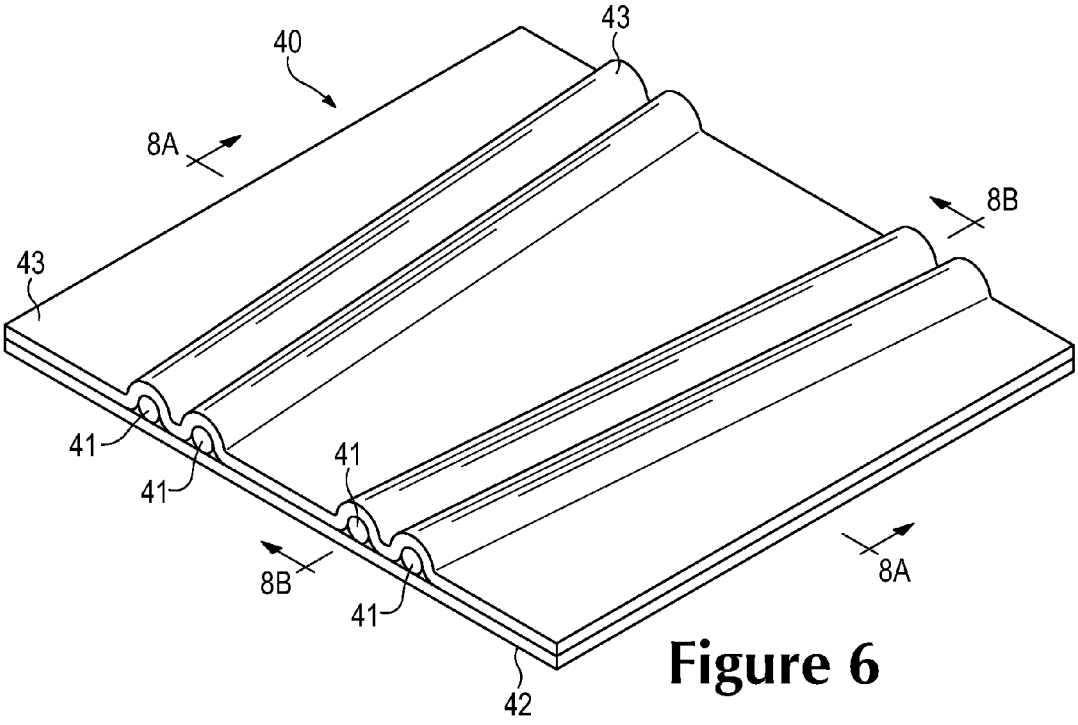
FIG. 6 is a perspective view of a first portion of the tensile strand element, as defined in FIG. 5.
Figure 7:
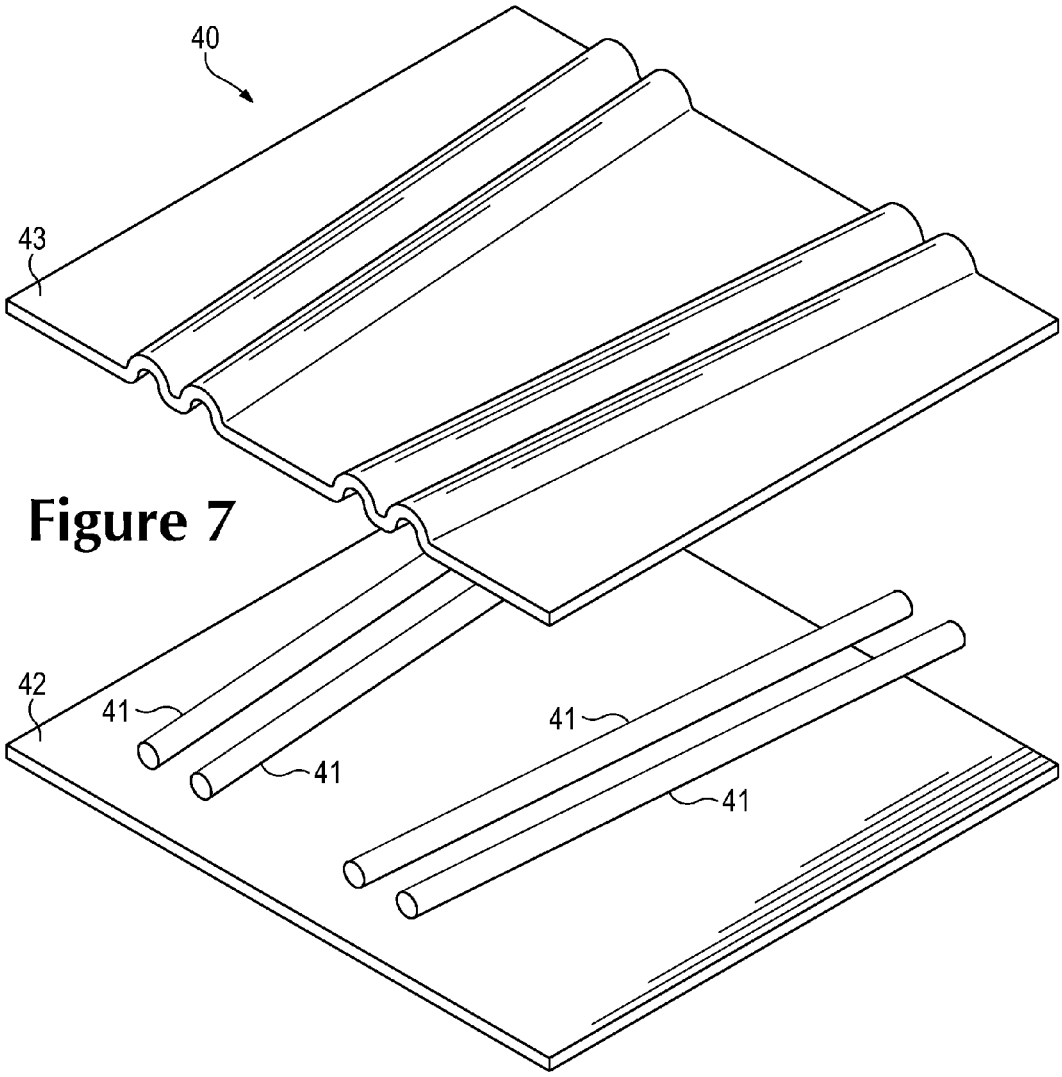
FIG. 7 is an exploded perspective view of the first portion of the tensile strand element.

A tensile strand element 40 that may be incorporated into upper 30 is depicted in FIG. 5. When incorporated into footwear 10, element 40 has a configuration that (a) extends from forefoot region 11 to heel region 13 on each of sides 14 and 15, (b) defines portions of ankle opening 31, (c) defines portions of throat area 32, including lace-receiving elements 33-35, (d) forms both an interior surface (i.e., the surface that contacts the foot or a sock worn by the foot when footwear 10 is worn) and an exterior surface (i.e., an outer, exposed surface of footwear 10), and (e) includes the various strands 41. Although element 40 extends through a majority of upper 30, element 40 may have a configuration that only forms particular area of upper 30. For example, element 40 may be limited to forefoot region 11 or may extend through only one of lateral side 14 and medial side 15. In these configurations, additional elements may be joined to element 40 to form further areas of upper 30.

A first portion of element 40 is depicted in each of FIGS. 6-8B. Element 40 includes base layer 42 and cover layer 43, with strands 41 being positioned between layers 42 and 43. Strands 41 lay adjacent to a surface of base layer 42 and substantially parallel to the surface of base layer 42. In general, strands 41 also lay adjacent to a surface of cover layer 43 and substantially parallel to the surface of cover layer 43. As discussed above, strands 41 form structural components in upper 30 that resist stretch. By being substantially parallel to the surfaces of base layer 42 and cover layer 43, strands 41 resist stretch in directions that correspond with the planes on which the surfaces of layers 42 and 43 lay. Although strands 41 may extend through base layer 42 (e.g., as a result of stitching) in some locations, areas where strands 41 extend through base layer 42 may permit stretch, thereby reducing the overall ability of strands 41 to limit stretch. As a result, each of strands 41 generally lay adjacent to a surface of base layer 42 and substantially parallel to the surface of base layer 42 for distances of at least five centimeters or more.

Base layer 42 and cover layer 43 are depicted as being coextensive with each other. That is, layers 42 and 43 may have the same shape and size, such that edges of base layer 42 correspond and are even with edges of cover layer 43. In some manufacturing processes, (a) strands 41 are located upon base layer 42, (b) cover layer 43 is bonded to base layer 42 and strands 41, and (c) element 40 is cut from this combination to have the desired shape and size, thereby forming common edges for base layer 42 and cover layer 43. In this process, ends of strands 41 may also extend to edges of layers 42 and 43. Accordingly, edges of layers 42 and 43, as well as ends of strands 41, may all be positioned at edges of element 40.

Each of base layer 42 and cover layer 43 may be formed from any generally two-dimensional material. As utilized with respect to the present invention, the term "two-dimensional material" or variants thereof is intended to encompass generally flat materials exhibiting a length and a width that are substantially greater than a thickness. Accordingly, suitable materials for base layer 42 and cover layer 43 include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven or knitted fabric. The textiles may incorporate fibers that are arranged to impart one-directional stretch or multi-directional stretch, and the textiles may include coatings that form a breathable and water-resistant barrier, for example. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for base layer 42 and cover layer 43. Although two-dimensional materials may have smooth or generally untextured surfaces, some two-dimensional materials will exhibit textures or other surface characteristics, such as dimpling, protrusions, ribs, or various patterns, for example. Despite the presence of surface characteristics, two-dimensional materials remain generally flat and exhibit a length and a width that are substantially greater than a thickness. In some configurations, mesh materials or perforated materials may be utilized for either or both of layers 42 and 43 to impart greater breathability or air permeability.

Strands 41 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for strands 41 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as strands 41, fibers have a relatively short length and generally go through spinning or twisting processes to produce a strand of suitable length. An individual filament utilized in strands 41 may be formed form a single material (i.e., a monocomponent filament) or from multiple materials (i.e., a bicomponent filament). Similarly, different filaments may be formed from different materials. As an example, yarns utilized as strands 41 may include filaments that are each formed from a common material, may include filaments that are each formed from two or more different materials, or may include filaments that are each formed from two or more different materials. Similar concepts also apply to threads, cables, or ropes. The thickness of strands 41 may also vary significantly to range from 0.03 millimeters to more than 5 millimeters, for example. Although one-dimensional materials will often have a cross-section where width and thickness are substantially equal (e.g., a round or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

As examples, base layer 42 may be formed from a textile material and cover layer 43 may be formed from a polymer sheet that is bonded to the textile material, or each of layers 42 and 43 may be formed from polymer sheets that are bonded to each other. In circumstances where base layer 42 is formed from a textile material, cover layer 43 may incorporate thermoplastic polymer materials that bond with the textile material of base layer 42. That is, by heating cover layer 43, the thermoplastic polymer material of cover layer 43 may bond with the textile material of base layer 42. As an alternative, a thermoplastic polymer material may infiltrate or be bonded with the textile material of base layer 42 in order to bond with cover layer 43. That is, base layer 42 may be a combination of a textile material and a thermoplastic polymer material. An advantage of this configuration is that the thermoplastic polymer material may rigidify or otherwise stabilize the textile material of base layer 42 during the manufacturing process of element 40, including portions of the manufacturing process involving lying strands 41 upon base layer 42. This general concept is disclosed in U.S. patent application Ser. No. 12/180,235, which was filed in the U.S. Patent and Trademark Office on 25 Jul. 2008 and entitled Composite Element With A Polymer Connecting Layer, such prior application being entirely incorporated herein by reference.

Based upon the above discussion, element 40 generally includes two layers 42 and 43 with strands 41 located between. Although strands 41 may pass through one of layers 42 and 43, strands 41 generally lay adjacent to surfaces of layers 42 and 43 and substantially parallel to the surfaces layers 42 and 43 for at least five centimeters. Whereas a variety of one dimensional materials may be used for strands 41, one or more two dimensional materials may be used for layers 42 and 43.

Forward Lace-Receiving Element

Figure 9:
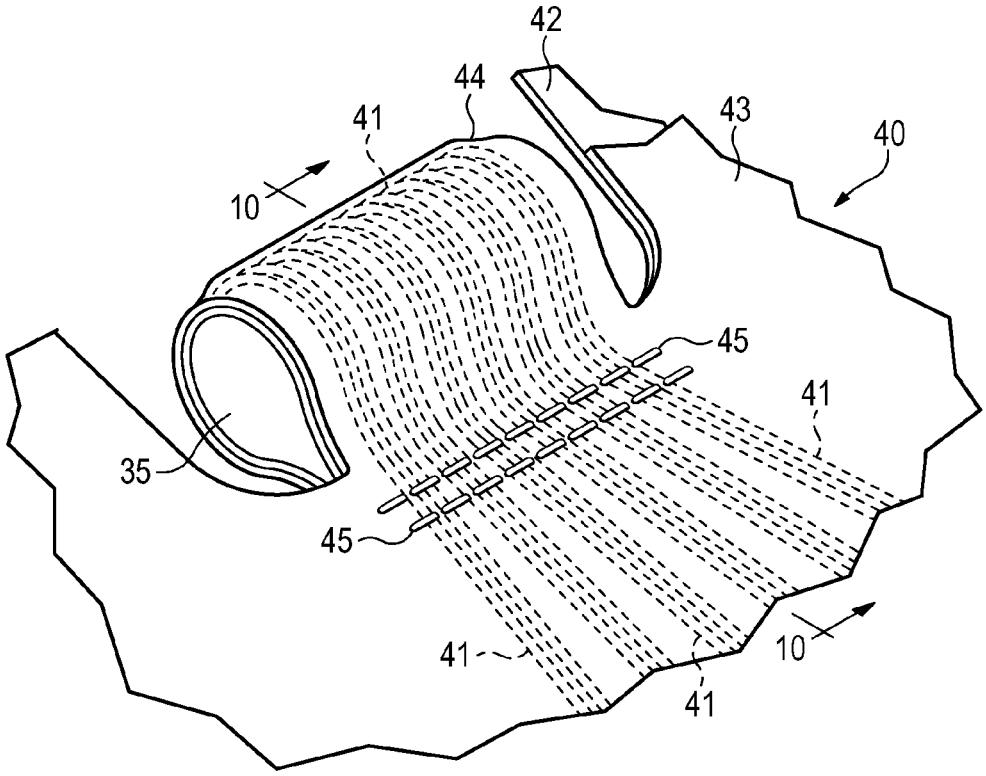
FIG. 9 is a perspective view of a second portion of the tensile strand element, as defined in FIG. 5.
Figure 10:
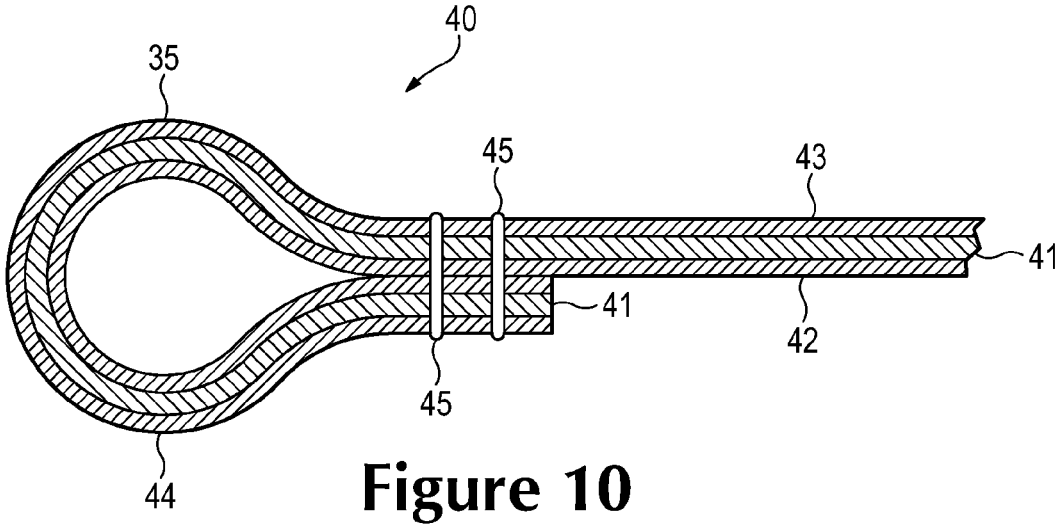
FIG. 10 is a cross-sectional views of the second portion of the tensile strand element, as defined by section line 10-10 in FIG. 9.
Figure 11:
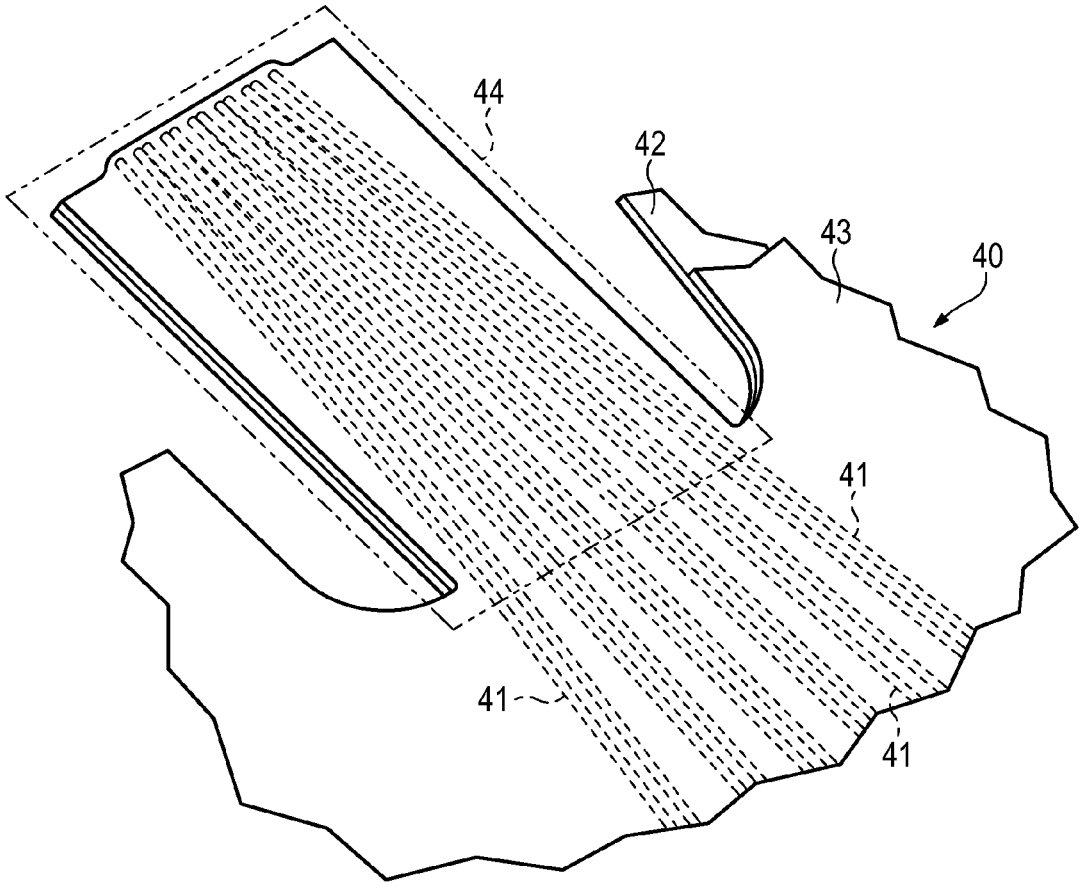
FIG. 11 is a perspective view of a second portion of the tensile strand element, prior to formation of a lace-receiving element.

A portion of element 40 that includes forward lace-receiving element 35 is depicted in FIGS. 9 and 10. As with other areas of element 40, this portion includes strands 41 and layers 42 and 43. Forward lace-receiving element 35 is formed as a loop of material that includes strands 41 and layers 42 and 43. Referring to FIG. 11, element 40 is depicted in a configuration prior to the formation of forward lace-receiving element 35 and includes a tab area 44. In order to form forward lace-receiving element 35, tab area 44 may be overlapped or folded upon itself (i.e., formed into a loop structure) and secured. Referring to FIG. 10, for example, stitching 45 extends through layers 42 and 43 to secure tab area 44 and form forward lace-receiving element 35. As an alternative to stitching 45, heat bonding or adhesives may be utilized to secure tab area 44 and form forward lace-receiving element 35.

Strands 41 extend onto tab area 44 and around forward lace-receiving element 35. As discussed above, strands 41 also extend around forward lace-receiving element 35 and forward from forward lace-receiving element 35 to resist stretch due to tension in lace 32. Given that strands 41 also radiate outward from forward lace-receiving element 35, forces from the tension in lace 32 or from movement of the foot may be distributed over a relatively large area of upper 30. By wrapping or extending strands 41 around forward lace-receiving element 35, forces from lace 32 are transferred to portions of strands 41 that extend forward from forward lace-receiving element 35. Accordingly, the configuration of forward lace-receiving element 35 interfaces with lace 32 to distribute forces over a relatively large area of upper 30.

Structural Components

A conventional upper may be formed from multiple material layers that each impart different properties to various areas of the upper. During use, an upper may experience significant tensile forces, and one or more layers of material are positioned in areas of the upper to resist the tensile forces. That is, individual layers may be incorporated into specific portions of the upper to resist tensile forces that arise during use of the footwear. As an example, a woven textile may be incorporated into an upper to impart stretch resistance in the longitudinal direction. A woven textile is formed from yarns that interweave at right angles to each other. If the woven textile is incorporated into the upper for purposes of longitudinal stretch-resistance, then only the yarns oriented in the longitudinal direction will contribute to longitudinal stretch-resistance, and the yarns oriented orthogonal to the longitudinal direction will not generally contribute to longitudinal stretch-resistance. Approximately one-half of the yarns in the woven textile are, therefore, superfluous to longitudinal stretch-resistance. As an extension of this example, the degree of stretch-resistance required in different areas of the upper may vary. Whereas some areas of the upper may require a relatively high degree of stretch-resistance, other areas of the upper may require a relatively low degree of stretch-resistance. Because the woven textile may be utilized in areas requiring both high and low degrees of stretch-resistance, some of the yarns in the woven textile are superfluous in areas requiring the low degree of stretch-resistance. In this example, the superfluous yarns add to the overall mass of the footwear, without adding beneficial properties to the footwear. Similar concepts apply to other materials, such as leather and polymer sheets, that are utilized for one or more of wear-resistance, flexibility, air-permeability, cushioning, and moisture-wicking, for example.

As a summary of the above discussion, materials utilized in the conventional upper formed from multiple layers of material may have superfluous portions that do not significantly contribute to the desired properties of the upper. With regard to stretch-resistance, for example, a layer may have material that imparts (a) a greater number of directions of stretch-resistance or (b) a greater degree of stretch-resistance than is necessary or desired. The superfluous portions of these materials may, therefore, add to the overall mass and cost of the footwear, without contributing significant beneficial properties.

In contrast with the conventional layered construction discussed above, upper 30 is constructed to minimize the presence of superfluous material. Base layer 42 and cover layer 43 provide a covering for the foot, but exhibit a relatively low mass. Strands 41 are positioned to provide stretch-resistance in particular directions and locations, and the number of strands 41 is selected to impart the desired degree of stretch-resistance. Accordingly, the orientations, locations, and quantity of strands 41 are selected to provide structural components that are tailored to a specific purpose.

Based upon the above discussion, strands 41 may be utilized to form structural components in upper 30. In general, strands 41 resist stretch to limit the overall stretch in upper 30. Strands 41 may also be utilized to distribute forces (e.g., forces from lace 32) to different areas of upper 30. Accordingly, the orientations, locations, and quantity of strands 41 are selected to provide structural components that are tailored to a specific purpose.

Further Footwear Configurations

Figure 12A:
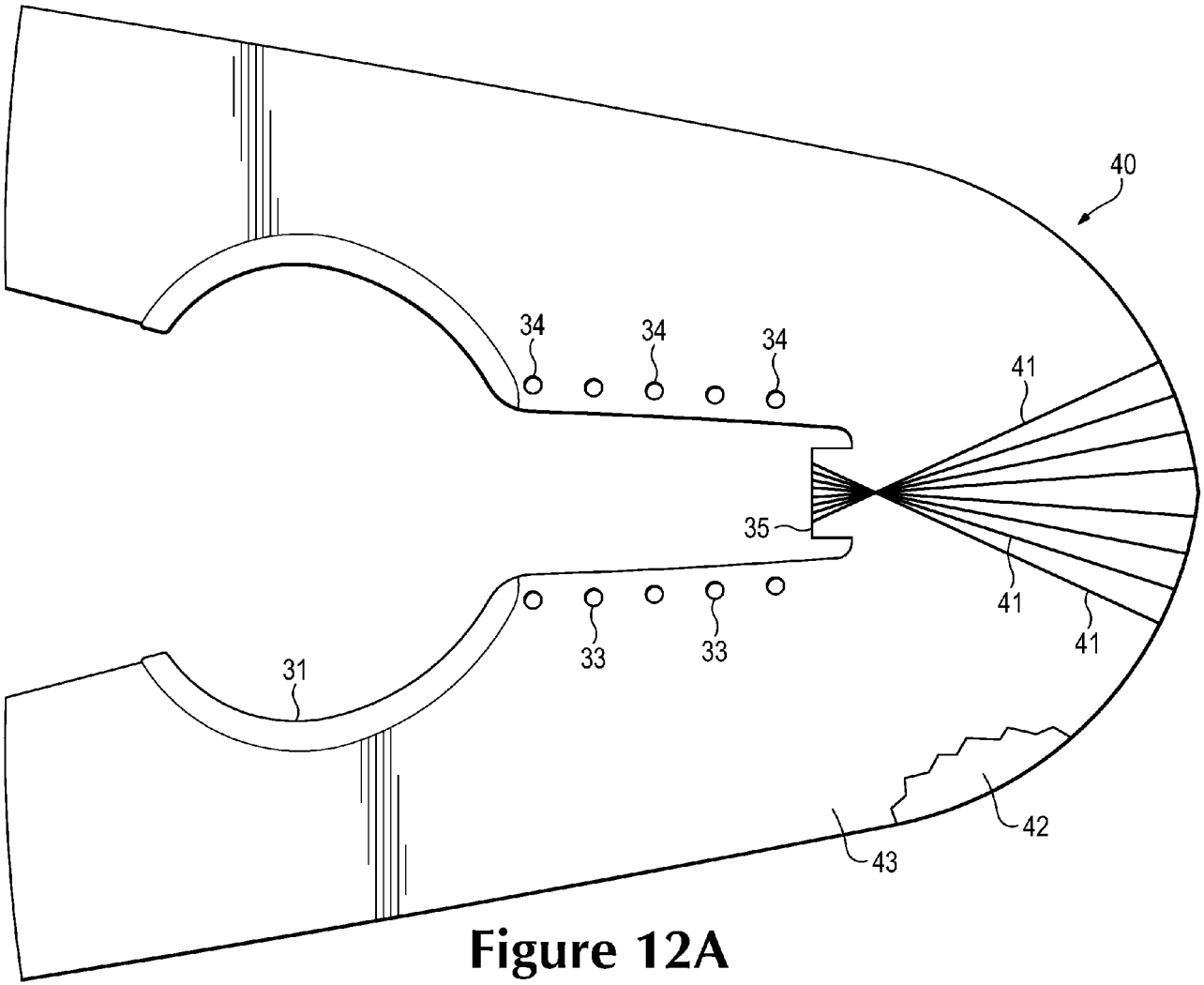
FIGS. 12A-12F are plan views corresponding with FIG. 5 and depicting further configurations of the tensile strand element.
Figure 12B:
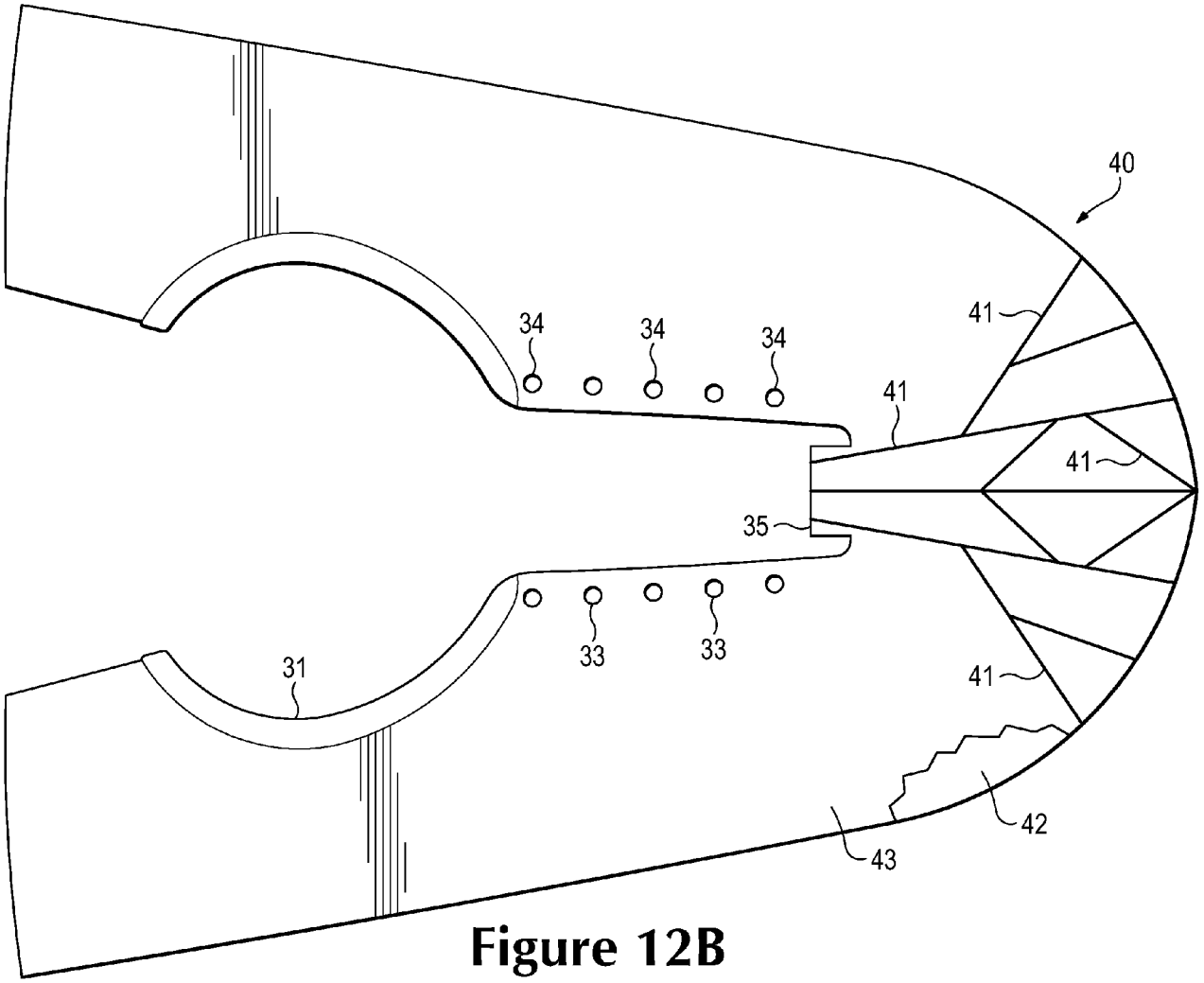
Figure 12C:
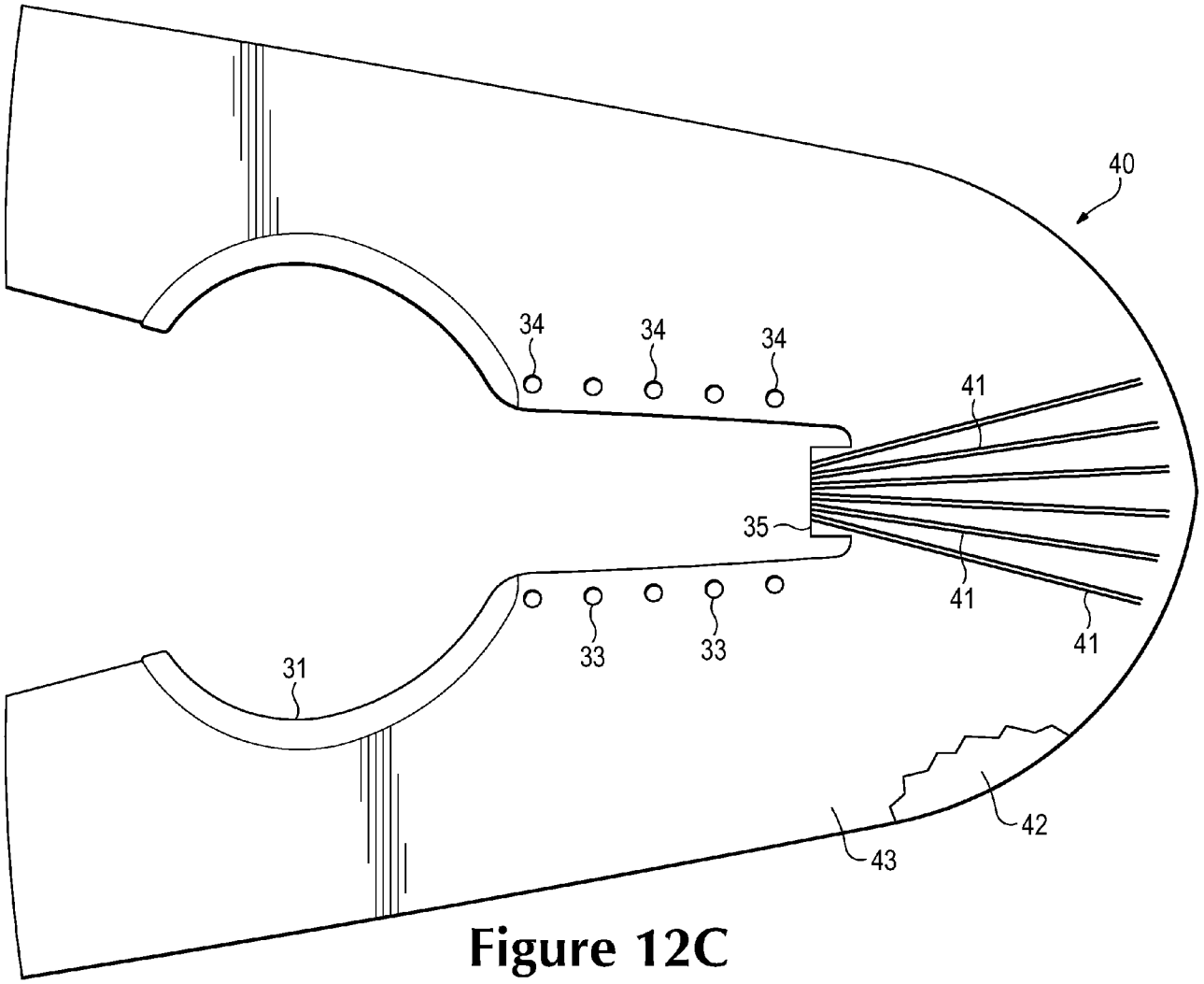
Figure 12D:
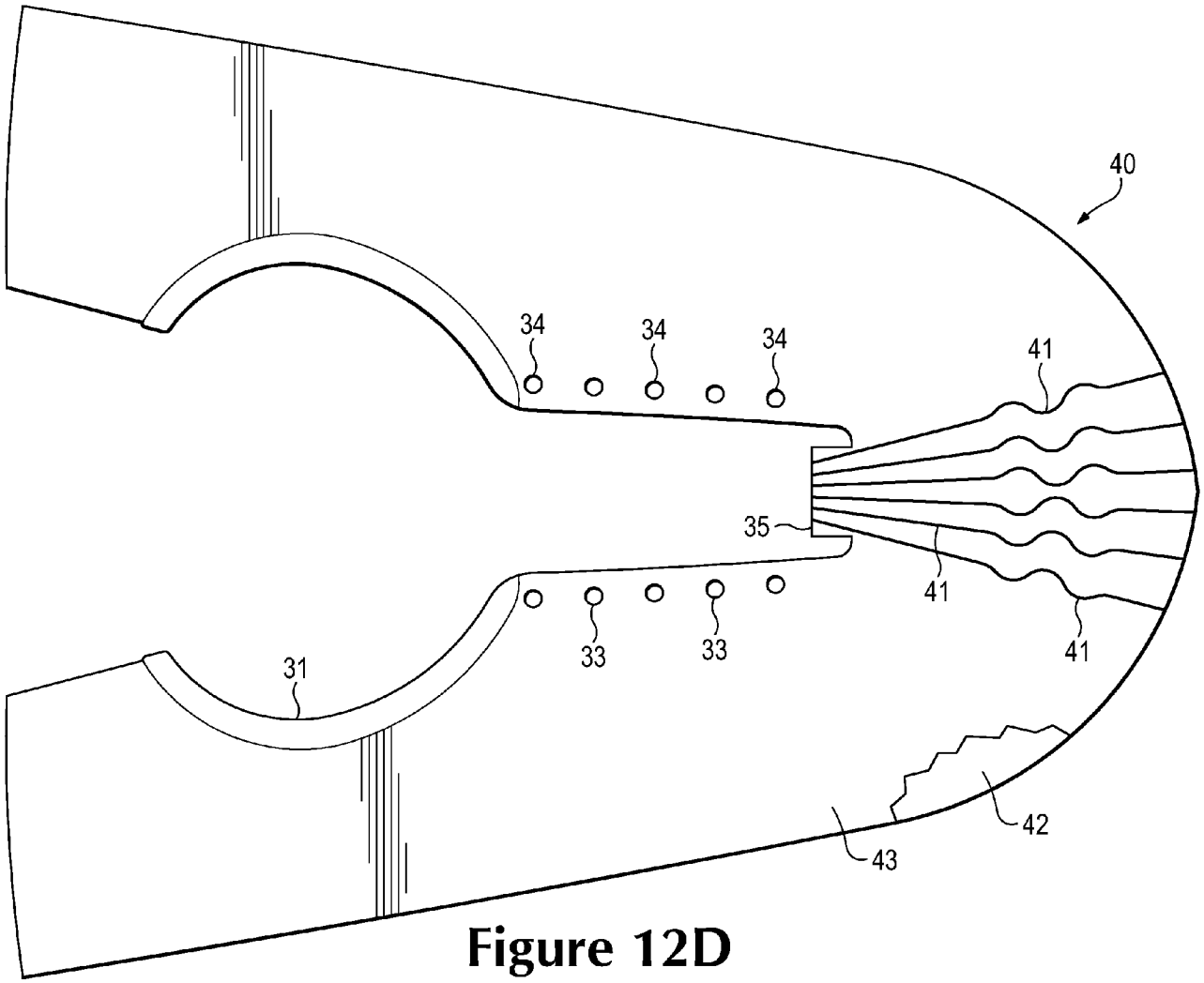
Figure 12E:
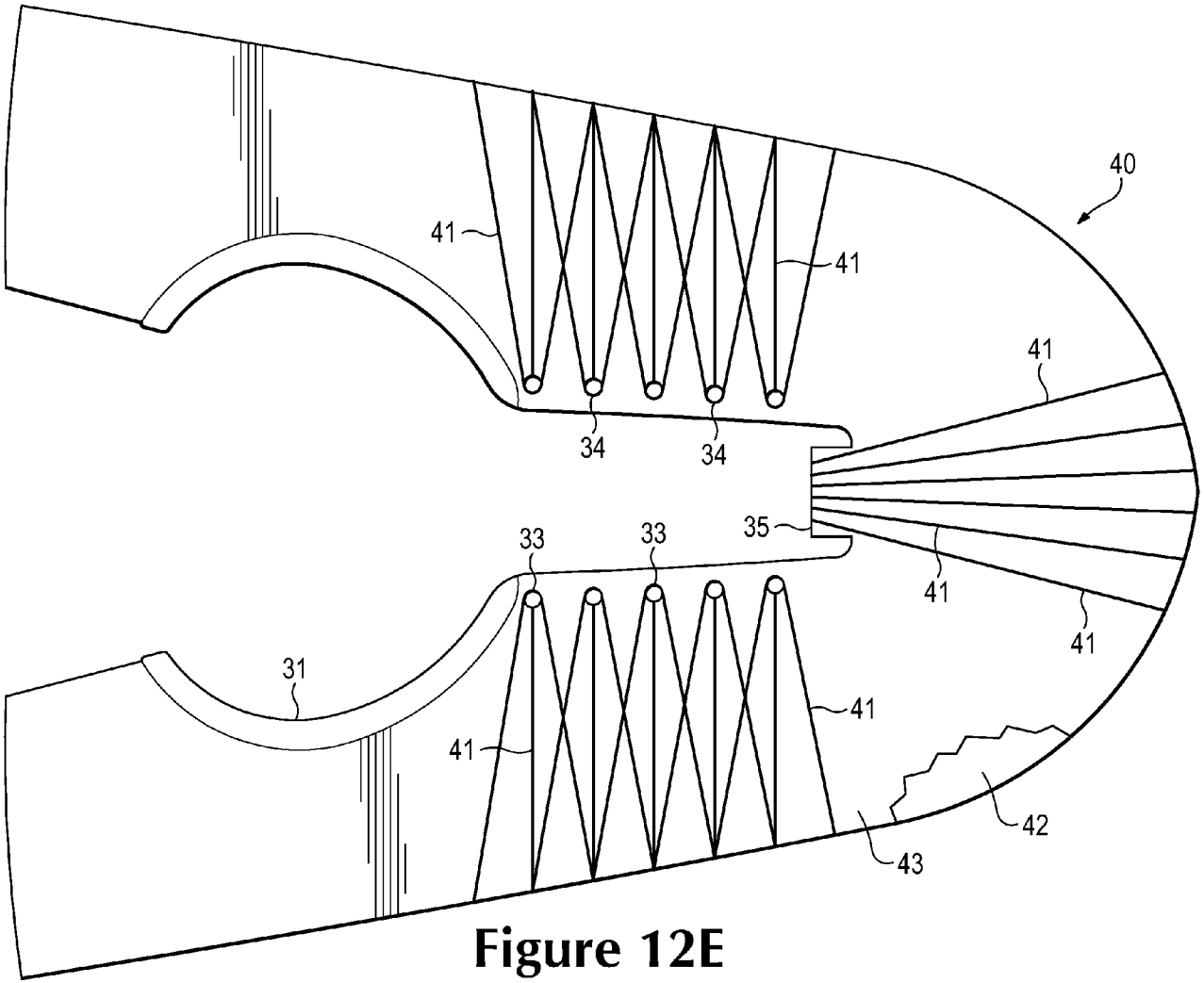
Figure 12F:
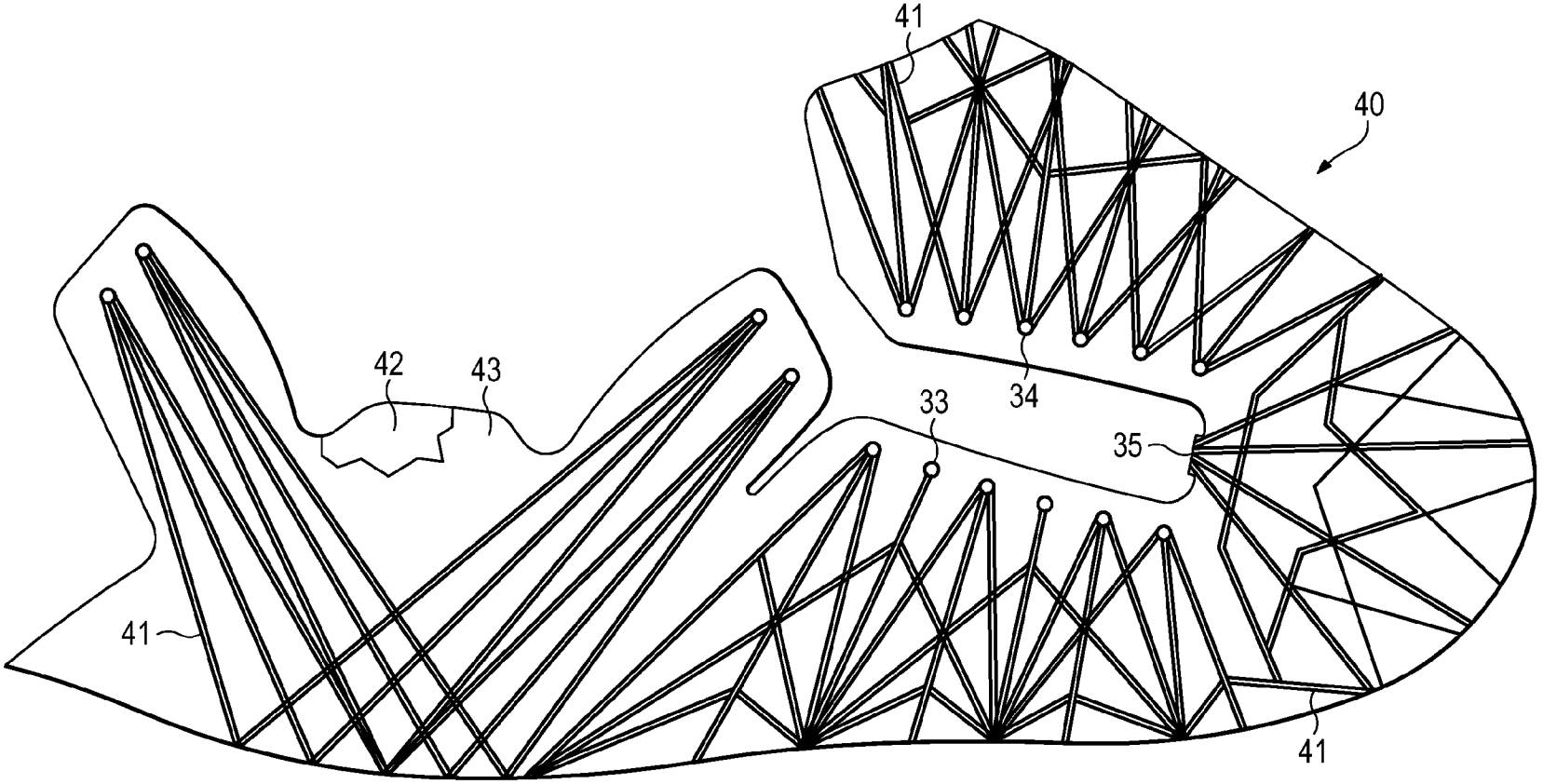

The orientations, locations, and quantity of strands 41 in FIGS. 1 and 2 are intended to provide an example of a suitable configuration for footwear 10. In other configurations of footwear 10, various strands 41 may be absent, or additional strands 41 may be present to provide further structural components in footwear 10. Referring to FIG. 12A, strands 41 cross each other in the area forward of forward lace-receiving element 35. Strands 41 may also exhibit a branching or web-like structure in the area forward of forward lace-receiving element 35, as depicted in FIG. 12B. Although some strands 41 do not extend onto and around forward lace-receiving element 35, strands 41 in this configuration may continue to resist stretch due to tension in lace 32 and distribute forces over a relatively large area of upper 30. In another configuration, depicted in FIG. 12C, strands 41 extend forward from forward lace-receiving element 35, but do not extend to edges of layers 42 and 43. In footwear 10, therefore, strands 41 may terminate in an area of forefoot region 11 that is located inward from forward edge 38. Although strands 41 may generally be linear, a configuration wherein portions of strands 41 are wavy or otherwise non-linear is depicted in FIG. 12D. As discussed above, strands 41 may resist stretch in upper 30, but the non-linear areas of strands 41 may allow some stretch in upper 30. As strands 41 straighten due to the stretch, however, strands 41 may then resist stretch in upper 30. Referring to FIG. 12E, strands 41 extend forward of forward lace-receiving element 35, and additional strands 41 extend outward from lace-receiving elements 33 and 34 and toward an area where sole structure 20 and upper 30 are joined. Accordingly, strands 41 may also be located in other areas of footwear 10 to resist stretch or otherwise provide structural components. This concept is generally discussed in U.S. Pat. No. 7,574,818 to Meschter, which is entirely incorporated herein by reference. Another configuration of element 40, which may be utilized in a basketball configuration of footwear 10, is depicted in FIG. 12F.

The running style or preferences of an individual may also determine the orientations, locations, and quantity of strands 41. For example, some individuals may have a relatively high degree of pronation (i.e., an inward roll of the foot), and having a greater number of strands 41 on lateral side 14 may reduce the degree of pronation. Some individuals may also prefer greater longitudinal stretch resistance, and footwear 10 may be modified to include further strands 41 that extend between regions 11-13 on both sides 14 and 15. Some individuals may also prefer that upper 30 fit more snugly, which may require adding more strands 41 throughout upper 30. Accordingly, footwear 10 may be customized to the running style or preferences of an individual through changes in the orientations, locations, and quantity of strands 41.

Figure 8A:
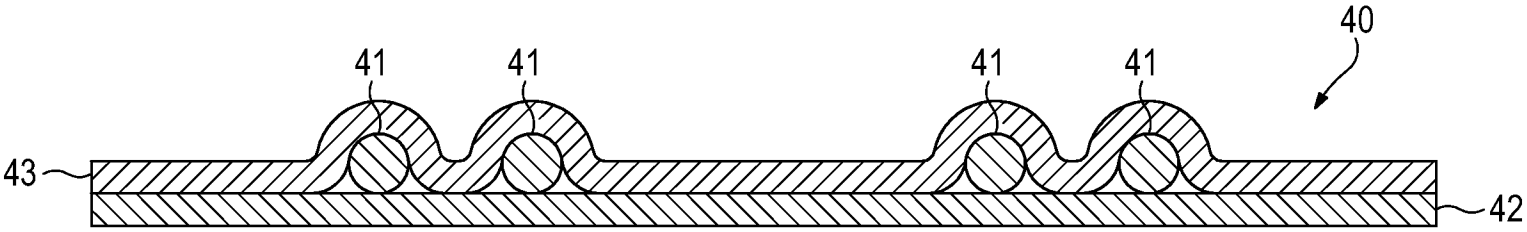
FIGS. 8A and 8B are cross-sectional views of the first portion of the tensile strand element, as defined by section lines 8A-8A and 8B-8B in FIG. 6.
Figure 8B:
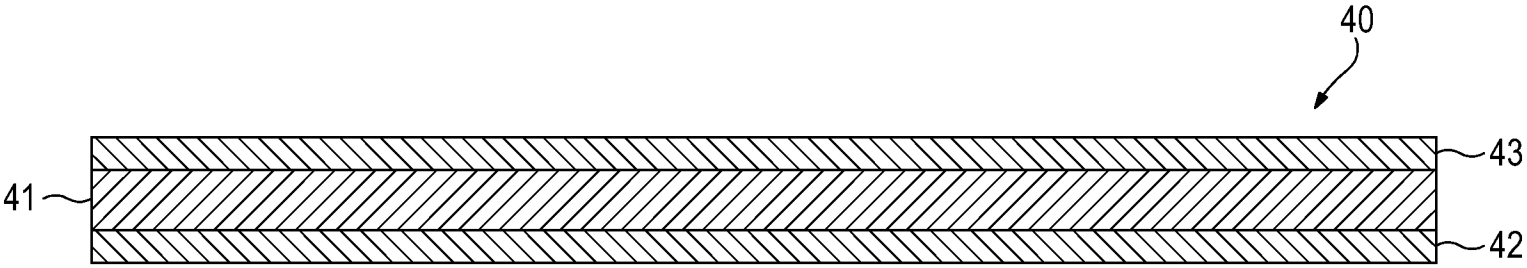
Figure 13A:
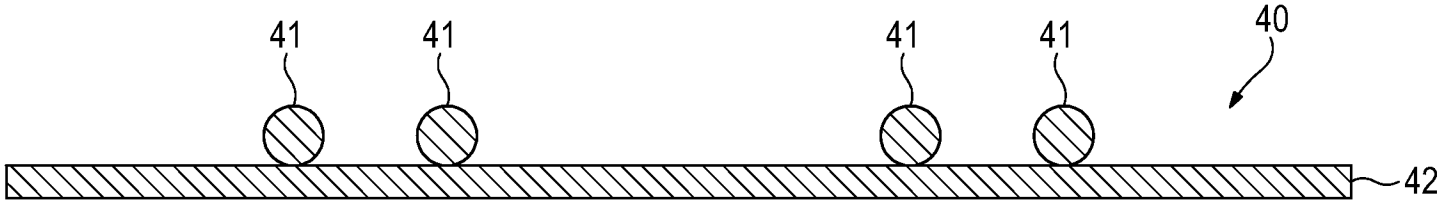
FIGS. 13A-13D are cross-sectional views corresponding with FIG. 8A and depicting further configurations of the tensile strand element.
Figure 13B:
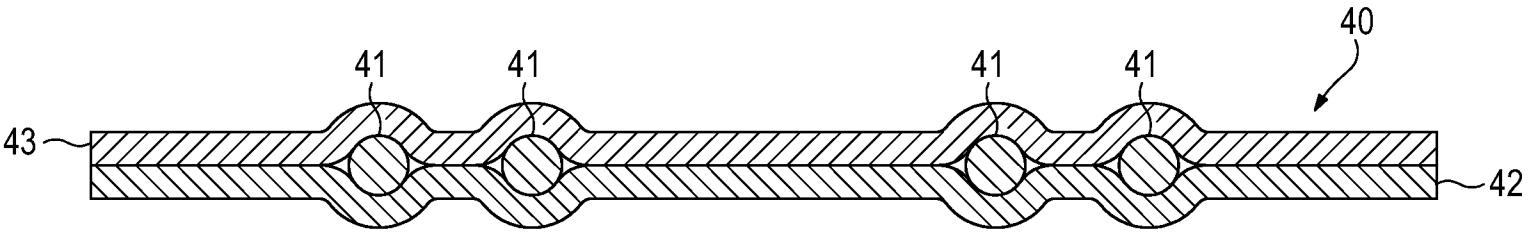
Figure 13C:
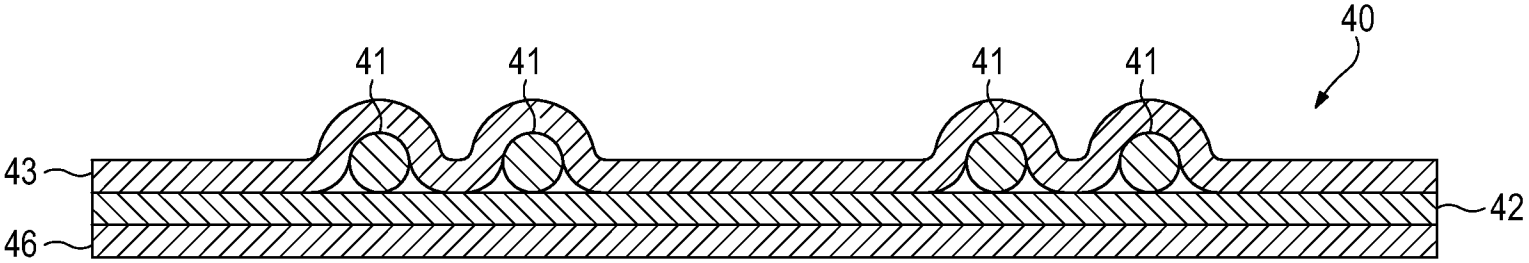
Figure 13D:
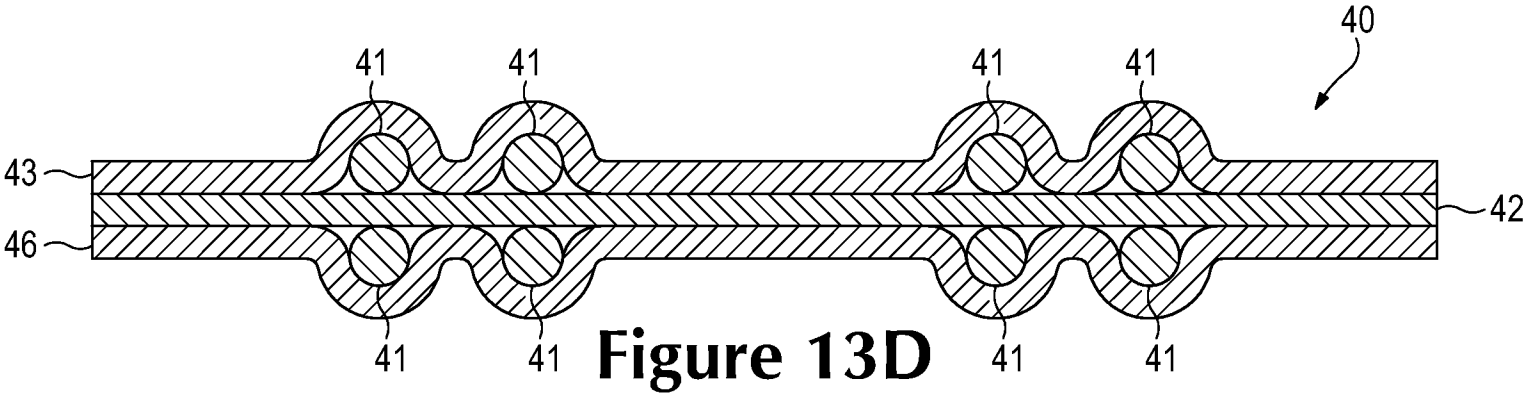

Various aspects relating to strands 41 and layers 42 and 43 in FIGS. 8A and 8B are intended to provide an example of a suitable configuration for element 40. In other configurations of element 40, additional layers or the positions of strands 41 with respect to layers 42 and 43 may vary. Referring to FIG. 13A, cover layer 43 is absent such that strands 41 are exposed. In this configuration, adhesives or a thermoplastic polymer material that infiltrates base layer 42 may be utilized to secure strands 41 to base layer 42. In FIG. 8A, base layer 42 is substantially planar, whereas cover layer 43 protrudes outward in the areas of strands 41. Referring to FIG. 13B, both of layers 42 and 43 protrude outward due to the presence of strands 41. In another configuration, depicted in FIG. 13C, an additional layer 46 is located adjacent to base layer 42. In footwear 10, layer 46 may form a surface of the void within upper 30. Referring to FIG. 13D, an additional set of strands 41 is located on an opposite side of base layer 42, with a 46 extending over the additional set of strands 41. This configuration may arise when an embroidery process is utilized to locate strands 41.

Figure 14A:
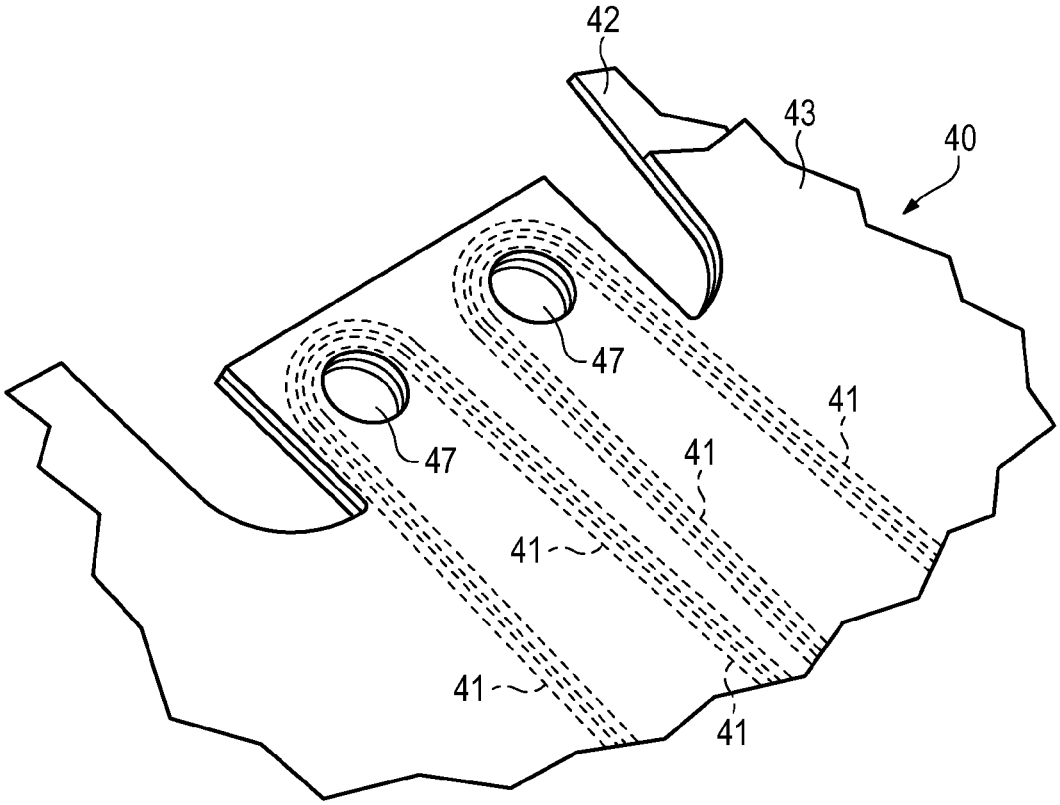
FIGS. 14A and 14B are perspective views corresponding with FIG. 9 and depicting further configurations of the tensile strand element.
Figure 14B:
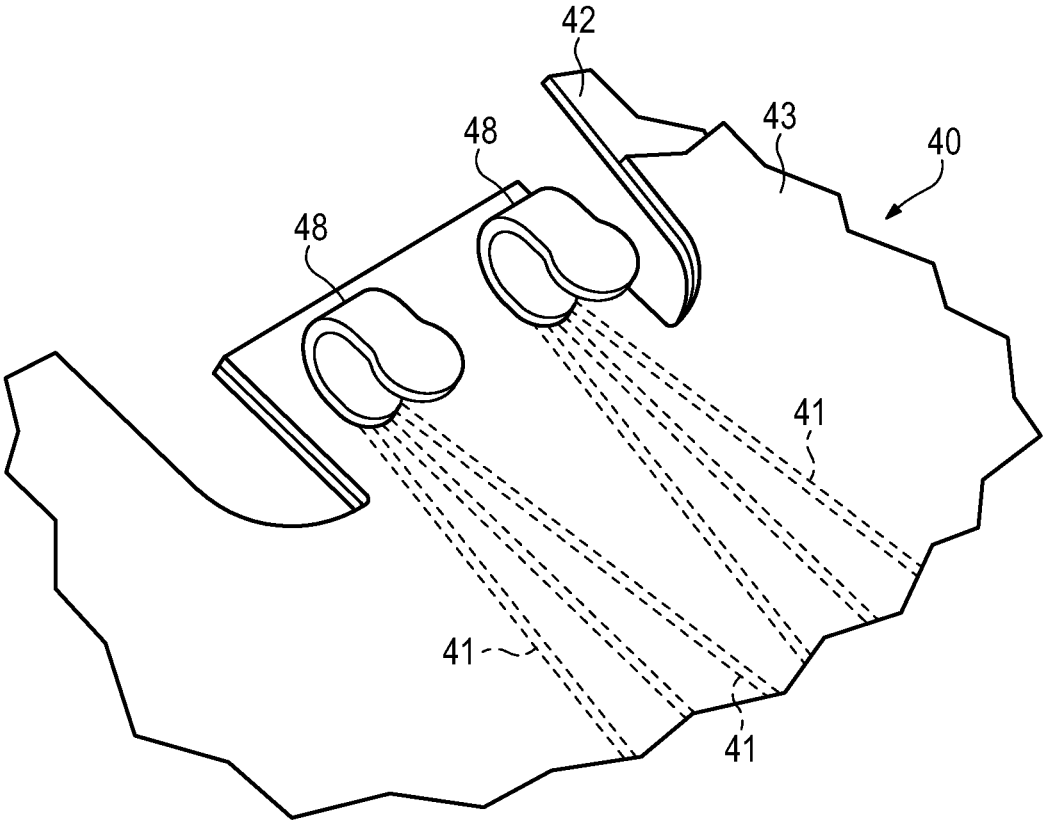

Forward lace-receiving element 35 is discussed above as having a loop structure, and strands 41 extend around the loop structure. In further configurations, forward lace-receiving element 35 may have different structures. For example, FIG. 14A depicts a configuration wherein two apertures 47 are utilized to provide an element for receiving lace 36. Note that strands 41 are depicted as extending around apertures 47. As another example, one or more hooks 48 may be utilized to receive lace 36, as depicted in FIG. 14B, and strands 41 extend under hooks 48. Accordingly, a variety of structures may be utilized to receive lace 36.

Manufacturing Method

A variety of methods may be utilized to manufacture upper 30 and, particularly, element 40. As an example, an embroidery process may be utilized to locate strands 41 relative to base layer 42. Once strands 41 are positioned, cover layer 43 may be bonded to base layer 42 and strands 41, thereby securing strands 41 within element 40 and between layers 42 and 43. This general process is described in detail in U.S. patent application Ser. No. 11/442,679, which was filed in the U.S. Patent and Trademark Office on 25 May 2006 and entitled Article Of Footwear Having An Upper With Thread Structural Elements, such prior application being entirely incorporated herein by reference. As an alternative to an embroidery process, other stitching processes may be utilized to locate strands 41 relative to base layer 42, such as computer stitching. Additionally, processes that involve winding strands 41 around pegs on a frame around base layer 42 may be utilized to locate strands 41 over base layer 42. Accordingly, a variety of methods may be utilized to locate strands 41 relative to base layer 42 in the manufacturing process of upper 30.

Footwear comfort is generally enhanced when the surfaces of upper 30 forming the void have relatively smooth or otherwise continuous configurations. In other words, seams, protrusions, ridges, and other discontinuities may cause discomfort to the foot. Referring to FIG. 4, base layer 42 has a relatively smooth aspect, whereas cover layer 43 protrudes outward in the areas of strands 41. In contrast, FIG. 13B depicts a configuration wherein base layer 42 and cover layer 43 protrude outward in the areas of strands 41. In general, the configuration of FIG. 4 may impart greater footwear comfort due to the greater smoothness to the surface forming the void within upper 30. A process disclosing a manner of forming a relatively smooth aspect to base layer 42 is described in detail in U.S. patent application Ser. No. 12/419,985, which was filed in the U.S. Patent and Trademark Office on 7 Apr. 2009 and entitled Method For Molding Tensile Strand Elements, such prior application being entirely incorporated herein by reference.

Conclusion

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. An article of footwear having an upper and a sole structure secured to the upper, the upper comprising:

a throat area extending forward from an ankle opening of the upper towards a forefoot region, the throat area including a plurality of lace-receiving elements that include a forward lace-receiving element positioned closer to a forward edge of the article of footwear than other lace-receiving elements, the forward lace-receiving element being centrally positioned and extending between a medial side and a lateral side of the throat area;

a lace extending through at least the forward lace-receiving element;

a tensile strand element located within the forefoot region of the article of footwear, the tensile strand element including (i) at least one material layer, and (ii) a plurality of strands that lay adjacent to a surface of the material layer, the tensile strand element forming a loop that defines the forward lace-receiving element, the plurality of strands extending at least partially around the loop; and wherein the plurality of strands extend from an area proximal to the forward lace-receiving element on a top portion of the upper located forward of the throat area towards the forward edge of the article of footwear.

2. The article of footwear according to claim 1, wherein the plurality of strands extend to the forward edge.

3. The article of footwear according to claim 1, wherein the plurality of strands terminate inward of the forward edge.

4. The article of footwear according to claim 1, wherein the plurality of strands cross each other between the area proximal to the forward lace-receiving element and the forward edge.

5. The article of footwear according to claim 1, wherein the plurality of strands exhibit a branching structure on the top portion of the upper located forward of the throat area.

6. The article of footwear according to claim 1, wherein at least a portion of the plurality of strands exhibit a wavy or non-linear configuration on the top portion of the upper located forward of the throat area.

7. The article of footwear according to claim 1, wherein the plurality of strands further extend through portions of at least a midfoot region and a heel region of the article of footwear.

8. The article of footwear according to claim 1, wherein the plurality of strands are exposed on the tensile strand element.

9. The article of footwear according to claim 1, wherein the at least one material layer of the tensile strand element comprises a base layer and a cover layer; and wherein the plurality of strands are located between the base layer and the cover layer in the tensile strand element.

10. The article of footwear according to claim 9, wherein the base layer is substantially planar and the cover layer protrudes outward in the location of the plurality of strands.

11. The article of footwear according to claim 9, wherein the base layer and the cover layer protrude outward in the location of the plurality of strands.

12. The article of footwear according to claim 9, further comprising an additional layer located adjacent to the base layer.

13. The article of footwear according to claim 9, wherein the plurality of strands are disposed along a first side of the base layer; and wherein an additional set of strands is located along a second side of the base layer opposite the first side.

14. The article of footwear according to claim 13, wherein an additional layer is located adjacent to the second side of the base layer, the additional layer covering the additional set of strands.

15. An article of footwear having an upper and a sole structure secured to the upper, the upper comprising:

a throat area extending forward from an ankle opening of the upper towards a forefoot region, the throat area including a plurality of lateral lace-receiving elements extending along a lateral side of the upper, a plurality of medial lace-receiving elements extending along a medial side of the upper, and a forward lace-receiving element centrally positioned and extending between the lateral side and the medial side at a forward portion of the throat area adjacent to the forefoot region;

a lace extending through the lateral lace-receiving elements, the medial lace-receiving elements, and the forward lace-receiving element;

a tensile strand element located within the forefoot region of the footwear, the tensile strand element including a first layer, a second layer, and a plurality of strands located between the first layer and the second layer;

wherein at least the first layer, the second layer, and the plurality of strands form the forward lace-receiving element being centrally positioned on a top portion of the upper located forward of the throat area;

wherein the first layer, the second layer, and the plurality of strands extend forward from an area proximal to the forward lace-receiving element on the top portion of the upper towards a forward edge of the article of footwear; and wherein the forward lace-receiving element is a loop formed by the first layer, the second layer, and the plurality of strands extending at least partially around the loop.

* * * * *